US009207573B2

(12) United States Patent
Nanno

(10) Patent No.: US 9,207,573 B2
(45) Date of Patent: Dec. 8, 2015

(54) IMAGE FORMING APPARATUS AND METHOD

(71) Applicant: Shigeo Nanno, Kyoto (JP)

(72) Inventor: Shigeo Nanno, Kyoto (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/600,491

(22) Filed: Jan. 20, 2015

(65) Prior Publication Data

US 2015/0220018 A1 Aug. 6, 2015

(30) Foreign Application Priority Data

Jan. 31, 2014 (JP) ..... 2014-016345

(51) Int. Cl.
*G03G 15/00* (2006.01)
*G03G 15/08* (2006.01)
*G03G 15/01* (2006.01)

(52) U.S. Cl.
CPC ..... *G03G 15/0865* (2013.01); *G03G 15/0178* (2013.01); *G03G 15/757* (2013.01); *G03G 2221/0005* (2013.01)

(58) Field of Classification Search
CPC ..... G03G 15/0865; G03G 15/757; G03G 15/0178; G03G 2221/0005
See application file for complete search history.

(56) References Cited

U.S. PATENT DOCUMENTS

2010/0303504 A1* 12/2010 Funamoto et al. ..... 399/167

FOREIGN PATENT DOCUMENTS

JP 2006-072172 3/2006
JP 2007-328088 12/2007

* cited by examiner

*Primary Examiner* — Ryan Walsh
(74) *Attorney, Agent, or Firm* — Harness, Dickey & Pierce, P.L.C.

(57) ABSTRACT

An image forming apparatus includes multiple image forming units each accommodating an image bearer and a developer bearer to develop a latent image formed on the image bearer. Each of the image forming units other than a prescribed image forming unit runs in an ordinary reverse rotation mode, in which at least one of the image bearer and the developer bearer rotates in an opposite direction during a non-image formation time period. The prescribed image forming unit runs in a special reverse rotation mode, in which at least one of the image bearer and the developer bearer rotates in the opposite direction during the non-image formation time period based on a differentiated one of a rotation time period, a start timing, a rotational speed, and a frequency of operation from those of the other image forming units, or does not run in the special reverse rotation mode.

20 Claims, 7 Drawing Sheets

IMAGE FORMING APPARATUS AND METHOD

CROSS-REFERENCE TO RELATED APPLICATION

This patent application is based on and claims priority pursuant to 35 U.S.C. §119(a) to Japanese Patent Application No. 2014-016345, filed on Jan. 31, 2014, in the Japan Patent Office, the entire disclosure of which is hereby incorporated by reference herein.

BACKGROUND

1. Technical Field

Embodiments of this invention relate to an image forming apparatus, such as a copier, a printer, a facsimile machine, and a multifunctional peripheral configured by combining these devices, and a method for forming an image, and especially to an image forming apparatus and method that rotates an image bearer and a developer bearer in reverse when an ordinary image forming process is stopped operating.

2. Related Art

Conventionally, to remove foreign substances, such as paper dust, etc., entering a gap formed between a photoconductive drum (e.g., an image bearer) and a cleaning blade in an image forming apparatus, such as a copier, a printer, etc., the photoconductive drum is rotated in reverse after an ordinary printing operation is completed.

It is known to positively rotate the photoconductive drum again after completing the printing operation and rotating the photoconductive drum. Further, it is also known to differentiate a reverse rotational speed of the photoconductive drum rotating after completing the ordinary printing operation from a rotational speed thereof when positively rotating.

SUMMARY

Accordingly, one aspect of the present invention provides a novel image forming apparatus that includes multiple image forming units driven by at least one driving motor under control of a driving controller. Each of the multiple image forming units includes an image bearer to bear a latent image while traveling in a first direction to provide positive rotation, and a developer bearer opposed to the image bearer to develop the latent image borne on the image bearer to obtain a toner image while traveling in a second direction opposite the first direction to provide positive rotation. The driving controller controls the at least one driving motor to render the image forming units other than at least one prescribed image forming unit of the multiple image forming units each to run in an ordinary reverse rotation mode, in which at least one of the image bearer and the developer bearer included in each of the image forming units other than at least one prescribed image forming unit of the multiple image forming units rotates in an opposite direction to a corresponding one of the first direction and the second direction to provide ordinary reverse rotation during a non-image formation time period. The driving controller either differentiates one of a rotation time period, a start timing, a rotational speed, and a frequency of operation of the at least one driving motor from those used in the ordinary reverse rotation mode of the image forming units other than the at least one prescribed image forming unit of the multiple image forming units and runs the at least one prescribed image forming unit in a special reverse rotation mode, in which at least one of the image bearer and the developer bearer included in the at least one prescribed image forming unit rotates in the opposite direction to a corresponding one of the first direction and the second direction based on the differentiated one of a rotation time period, a start timing, a rotational speed, and a frequency of operation to provide special reverse rotation during the non-image formation time period, or stops the at least one driving motor not to run the at least one prescribed image forming unit in the special reverse rotation mode Another aspect of the present invention provides a novel method of forming an image by using multiple image forming units driven by at least one driving motor under control of a driving controller. The method includes the steps of bearing a latent image while traveling in a first direction to provide positive rotation in each of the multiple image forming units, bearing developer and developing a latent image borne on the image bearer to obtain a toner image while traveling in a second direction opposite the first direction to provide positive rotation in each of the multiple image forming units, running each of the image forming units other than at least one prescribed image forming unit of the multiple image forming units in an ordinary reverse rotation mode during a non-image formation time period by rotating at least one of the image bearer and the developer bearer included in each of the image forming units other than the at least one prescribed image forming unit in an opposite direction to a corresponding one of the first direction and the second direction to provide ordinary reverse rotation, differentiating one of a rotation time period, a start timing, a rotational speed, and a frequency of operation of the at least one driving motor from those used in the ordinary reverse rotation mode of the image forming units other than the at least one prescribed image forming unit of the multiple image forming units, and either running the at least one prescribed image forming unit in a special reverse rotation mode, in which at least one of the latent image bearer and the developer bearer included in the at least one prescribed image forming unit of the multiple image forming units rotates in the opposite direction to a corresponding one of the first direction and the second direction based on the differentiated one of a rotation time period, a start timing, a rotational speed, and a frequency of operation to provide special reverse rotation during the non-image formation time period, or stopping the at least one driving motor not to run the at least one prescribed image forming unit in the special reverse rotation mode.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

In many conventional image forming apparatuses, such as a color image forming apparatus that includes multiple image forming units that form black, yellow, magenta, and cyan images, in which photoconductive drums (i.e., image bearers) and developing rollers (i.e., developer bearers) are rotated in reverse in the same way, respectively, a driving source disposed in a developer unit to drive the developing roller also drives the photoconductive drum at the same time as well. In such conventional image forming apparatuses, when the photoconductive drum is rotated in reverse, the developing roller is also rotated in reverse at the same time. Consequently, a defective image or the like is sometimes formed in some of the image forming units among the multiple image forming units. This invention is made to solve the above-described problem and an object of one embodiment thereof is to provide an image forming apparatus including multiple image forming units capable of inhibiting generation of an abnormal image with banding in every image forming units.

Figure 1:
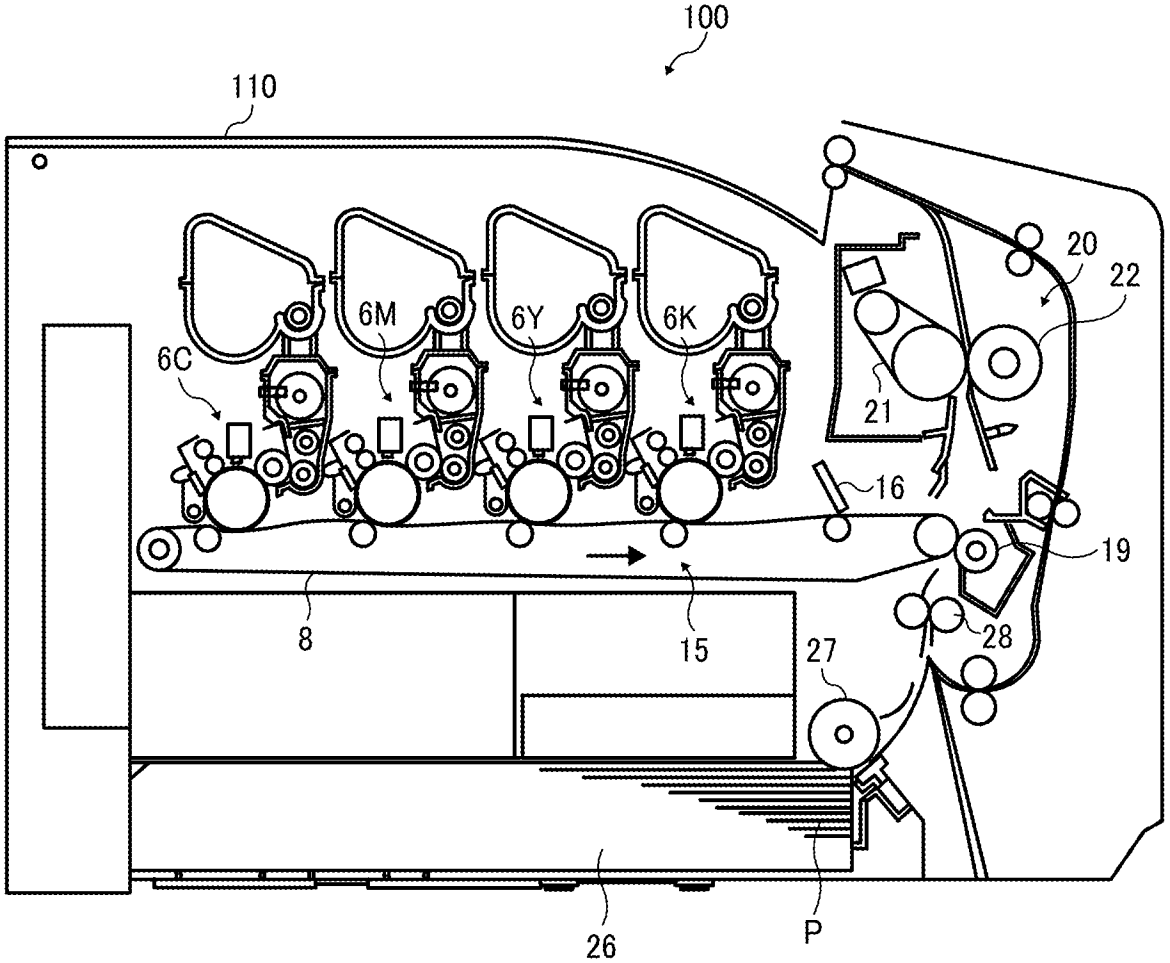
FIG. 1 is a diagram illustrating an overall configuration of an exemplary image forming apparatus according to one embodiment of the present invention.
Figure 2:
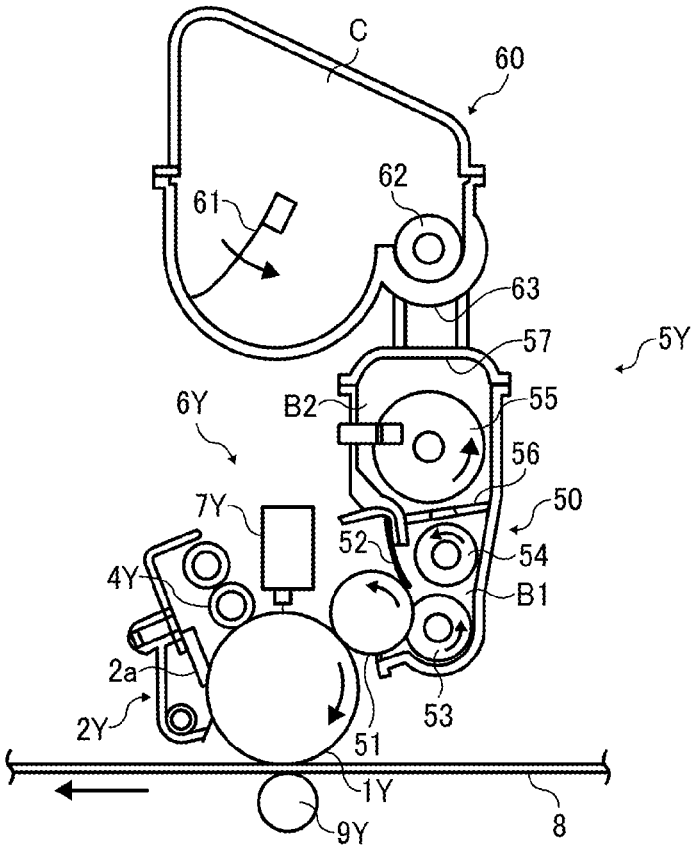
FIG. 2 is a cross-sectional view illustrating an exemplary image forming unit provided in the image forming apparatus of FIG. 1.

Referring now to the drawings, wherein like reference numerals designate identical or corresponding parts throughout the several views thereof and in particular to FIGS. 1 and 2, an exemplary image forming apparatus according to one embodiment of the present invention is described. As shown in FIG. 1, in the middle of a body of the image forming apparatus 100 of the image forming apparatus, an intermediate transfer belt unit 15 is installed. Further, multiple process cartridges 6Y, 6M, 6C, and 6K are arranged side by side for respective component colors (yellow, magenta, cyan, and black) and opposed to an intermediate transfer belt 8 (i.e., an intermediate transfer member) included in the intermediate transfer belt unit 15.

As shown in FIG. 2, a process cartridge 6Y for yellow is configured as a single unit by integrating a photoconductive drum 1Y as an image bearer, an electric charging unit 4Y (an electric charging device), a developer unit 5Y (i.e., a developing device), a cleaning unit 2Y (i.e., a cleaning device), and an electric charge removing device, not shown, each disposed around the photoconductive drum 1Y with each other. The single unit is attachably detached to the body of the image forming apparatus 100 of the image forming apparatus (i.e., replaceable). Hence, an image forming process (e.g., an electric charging process, an exposing process, a developing process, a transfer process, a cleaning process is executed on the photoconductive drum 1Y, so that a yellow image is formed on the photoconductive drum 1Y. That is, the process cartridge 6Y constitutes the image forming unit together with a primary transfer roller 9Y (i.e., a primary transfer device) or the like as well.

Here, the other remaining three process cartridges 6M, 6C, and 6K (i.e., image forming units provided therein) also have nearly the similar configurations as the process cartridge 6Y (i.e., the image forming unit) handling yellow except for usage toner color, and form respective toner color images. Herein below, the process cartridge 6Y (i.e., the image forming unit) handling yellow is only typically described while sometimes omitting description of the remaining three other process cartridges 6M, 6C, and 6K (i.e., the image forming units provided therein).

As shown in FIG. 2, the photoconductive drum 1Y (i.e., the image bearer) is driven and is rotated clockwise (i.e., a designated positive direction) by a driving motor (i.e., a driving source) not shown. Subsequently, at a position of an electric charging unit 4Y (e.g., an electric charging roller), a surface of the photoconductive drum 1Y is uniformly charged in an electric charging process. Subsequently, the surface of the photoconductive drum 1Y reaches an irradiation position, onto which an exposure light is emitted from the exposing unit 7Y (e.g., an optical writing head) in the exposing process, and a yellow electrostatic latent image is formed by exposure scanning at the position.

Subsequently, the surface of the photoconductive drum 1Y reaches an opposed position opposed to the developer unit 5Y (i.e., a developer unit main section 50). Subsequently, the electrostatic latent image is developed at this position so that a yellow toner image is formed in a developing process. Subsequently, the surface of the photoconductive drum 1Y reaches an opposed position opposed to the intermediate transfer belt 8 (i.e., an intermediate transfer member) and a primary transfer roller 9Y as well. At this position, the toner image on the photoconductive drum 1Y is transferred onto the intermediate transfer belt 8 in a primary transfer process. At this moment, a slight amount of untransferred toner remains on the photoconductive drum 1Y.

Subsequently, the surface of the photoconductive drum 1Y reaches an opposed position opposed to the cleaning unit 2Y. The untransferred toner remaining on the photoconductive drum 1Y is collected by a cleaning blade 2*a* at this position into the cleaning unit 2Y in a cleaning process. Finally, the surface of the photoconductive drum 1Y reaches an opposed position opposed to the electric charge removing section, not shown, so that a residual potential on the photoconductive drum is removed therefrom at this position. Thus, a series of image forming processes to be executed on the photoconductive drum 1Y is completed.

The above-described image forming processes is also executed in each of the other process cartridges 6M, 6C, and 6K (i.e., image forming units provided therein) as well as in the yellow process cartridge 6Y (i.e., the image forming unit). Specifically, from the exposing unit disposed above the image forming unit, exposure light generated based on image information is irradiated to each of the respective photoconductive drums in the process cartridges 6M, 6C, and 6K. Toner images of respective colors are accordingly formed on the photoconductive drums in the developing processes and are transferred to and overlaid on the intermediate transfer belt 8. Hence, a color image is ultimately formed on the intermediate transfer belt 8.

Here, as shown in FIG. 1, the intermediate transfer belt unit 15 is configured by the intermediate transfer belt 8, four primary transfer rollers 9Y (see FIG. 2), and driving and driven rollers. Thus, the intermediate transfer belt 8 is stretched and suspended (i.e., supported) by the four primary transfer rollers 9Y (see FIG. 2) and driving and driven rollers, and endlessly moves as the driving roller rotates in a direction as shown by an arrow as shown in FIG. 1 (i.e., counterclockwise).

The primary transfer roller 9Y forms a primary transfer nip by pressing against the photoconductive drum 1Y via the intermediate transfer belt 8 therebetween. A transfer voltage (i.e., a transfer bias) having an opposite polarity to a toner polarity is applied to the primary transfer roller 9Y. The intermediate transfer belt 8 travels through the respective primary transfer nips of the primary transfer rollers (9Y) sequentially in a direction as shown by an arrow in the drawing. Thus, respective color toner images on the photoconductive drums (1Y) are primary transferred onto the intermediate transfer belt 8 and are overlaid each other thereon.

The intermediate transfer belt 8 bearing the superimposed color toner image thereon then reaches an opposed position opposed to a secondary transfer roller 19 (i.e., a secondary transfer unit). At this position, a driving roller (i.e., a secondary transfer opposed roller) and the secondary transfer roller 19 hold the intermediate transfer belt 8 and form a secondary transfer nip therebetween. Thus, the four-color toner superimposed image borne on the intermediate transfer belt 8 is transferred onto a recording medium P such as a transfer sheet, etc., conveyed up to a position of the secondary transfer nip (i.e., in a secondary transfer process. At this moment, toner not transferred onto the recording medium P (i.e., untransferred toner) remains on the intermediate transfer belt 8.

Subsequently, the untransferred toner on the intermediate transfer belt 8 reaches a position of an intermediate transfer belt cleaning device 16 (e.g., an intermediate transfer belt cleaning blade). Thus, at this position, the untransferred toner on the intermediate transfer belt 8 is mechanically removed by the intermediate transfer belt cleaning blade (i.e., the intermediate transfer belt cleaning device 16), because it is brought in pressure contact with the intermediate transfer belt 8. Here, the intermediate transfer belt cleaning blade has a planar member made of elastic material such as polyurethane, etc., and contacts the intermediate transfer belt 8 at a prescribed contacting angle with a prescribed amount of contact pressure. In this way, a series of transfer processes to be executed on the intermediate transfer belt 8 is completed.

Here, as shown in FIG. 1, the recording medium P is conveyed to the position of the secondary transfer nip from the sheet feeding unit 26 disposed at a bottom of the apparatus body of the image forming apparatus 100 via a sheet conveying path in which a sheet feeding roller 27 and a pair of registration rollers 28 (i.e., a pair of timing rollers) or the like are arranged. Specifically, in the sheet feeding unit 26, multiple transfer sheets such as recording media P, etc., are stored being stacked. Thus, when the sheet feeding roller 27 is driven and is rotated counterclockwise in FIG. 1, the topmost recording medium P is fed toward a nip between the pair of registration rollers 28.

The recording medium P conveyed up to the pair of registration rollers 28 temporarily stops at the nip of the pair of registration rollers 28 stopped rotating at the time. Subsequently, the pair of registration rollers 28 is driven and is rotated synchronizing with the color image borne on the intermediate transfer belt to convey the recording medium P toward the secondary transfer nip. In this way, a desired color image is ultimately transferred onto the recording medium P.

Subsequently, the recording medium P bearing the color image transferred thereonto at the position of the secondary transfer nip is further conveyed to a position of a fixing unit 20 (i.e., a fixing nip). Thus, at this position, the color image (i.e., a toner image) transferred onto a surface of it is fixed onto the recording medium P by a fixing belt 21 (i.e., a fixing member) and a pressure roller 22 (a pressing member) with respective heat and pressure in a fixing process. Subsequently, the recording medium P is discharged by a pair of sheet ejection rollers to an outside of the image forming apparatus. The recording medium P discharged outside the image forming apparatus by the pair of sheet ejection rollers is sequentially stacked on a stacking section (e.g., a body cover 110) as an output image. Thus, a series of image forming processes to be executed in the image forming apparatus is completed.

Now, an image forming unit included in the image forming apparatus is described more in detail with reference to FIG. 2. As shown there, a process cartridge 6Y is configured by the photoconductive drum 1Y (i.e., an image bearer), an electric charging unit 4Y (e.g., an electric charging roller), a developer unit 5Y, and a cleaning unit 2Y or the like. The photoconductive drum 1Y is an organic photoconductor negatively charged to act as an image bearer, and is driven and rotated in a direction as shown in FIG. 2 upon receiving driving force from a driving motor, not shown, installed in the body of the image forming apparatus 100. Here, the driving motor is commonly used to drive and rotate a developing roller 51 as well as described later with reference to FIG. 6.

The electric charging roller (i.e., the electric charging unit 4Y) is an elastic roller configured by a cored bar and a foamed polyurethane layer overlying the cored bar prepared by mixing polyurethane resin, carbon black as conductive particles, sulfide agents, and foaming agents, etc., together having a medium resistance. As material of the medium resistive layer of the electric charging roller (i.e., the electric charging unit 4Y), urethane, ethylene-propylene-dienepolyethylene (EPDM), butadiene acrylonitrile rubber (NBR), and silicone rubber or the like may be used. A rubber prepared by dispersing conductive material, such as carbon black, metal oxide, etc., in isoprene rubber, etc., to adjust resistance can be also used. Otherwise, foaming material prepared by foaming the above-described material can be used as well. In this embodiment, the electric charging roller (i.e., the electric charging unit 4Y) is brought in contact with the photoconductive drum 1Y. However, the electric charging roller (i.e., the electric charging unit 4Y) can be separated from the photoconductive drum 1Y. In the cleaning unit 2Y, a cleaning blade 2*a* is provided and is brought in sliding contact with the photoconductive drum 1Y to mechanically remove and collect untransferred toner borne on the photoconductive drum 1Y therefrom. The cleaning blade 2*a* is a planar member made of elastic material such as urethane rubber, etc., and brought in contact with the photoconductive drum 1Y at a given contact angle with a given amount of contact pressure.

In the developer unit 5Y, a developing roller 51 acting as a developer bearer is positioned to contact the photoconductive drum 1Y, so that a developing region (i.e., a developing nip) can be formed between the photoconductive drum 1Y and the developing roller 51. In the developer unit 5Y, toner T (non-magnetic or magnetic one component developer) is stored as developer. Hence, the developer unit 5Y develops and visualizes an electrostatic latent image formed on the photoconductive drum 1Y (thereby forming a toner image thereon).

Herein below, with reference to FIGS. 2 and 3, the developer unit 5Y is described more in detail. As shown in FIG. 2, the developer unit 5Y of this embodiment employs a contact type one component developing system. The developer unit 5Y is configured mainly by a developer unit main section 50 to develop an electrostatic latent image formed on the photoconductive drum 1Y and a toner container 60 acting as a developer container to supply toner T (e.g., one component developer) to the developer unit main section 50. The developer unit 5Y is detachably installed (replaceable) as a process cartridge 6Y into and from the body of the image forming apparatus 100 together with the other image forming units, such as the photoconductive drum 1Y, the cleaning unit 2Y, and the electric charging roller (i.e., the electric charging unit 4Y). The developer unit 5Y is configured to be able to replace the toner container 60 separately from the developer unit main section 50 (i.e., the process cartridge 6Y). Specifically, the toner container 60 is detachably installed (replaceable) from and to the developer unit main section 50 (the process cartridge 6Y) mounted on the body of the image forming apparatus 100 at an upper position thereof. Subsequently, by opening and closing a body cover 110 (see FIG. 1) around a hinge as a rotational center, not shown, either only the toner container 60 or together with the developer unit main section 50 (of the process cartridge 6Y) is separated therefrom and replaced. Here, the toner container 60 is replaced when the toner contained in its interior runs out. By contrast, the developer unit main section 50 (of the process cartridge 6Y) is replaced when a component (for example, the developing roller 51 and the photoconductive drum 1Y or the like) comes to the end of life and toner inside thereof runs out. That is, the toner container 60 can be replaced alone independently. By contrast, the developer unit main section 50 (i.e., the process cartridge 6Y) is replaced together with the toner container 60 (attached thereto).

The developer unit main section 50 is configured by the developing roller 51 acting as a developer bearer, a developer supplying roller 53 acting as a developer supplying member, a doctor blade 52 acting as a developer amount regulating member, first and second toner conveying screws 54 and 55 acting as toner conveying members, a partition member 56 for separating a first toner conveying path B1 established by the first toner conveying screw 54 from a second toner conveying path B2 established by the second toner conveying screw 55, and a main section side toner supplying mouth 57 to which toner is supplied from a toner container 60 or the like.

Figure 3:
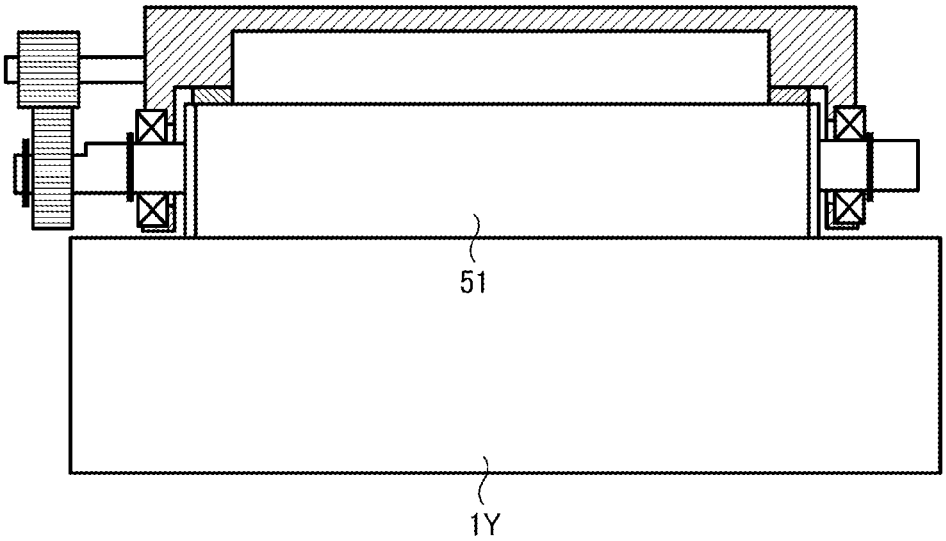
FIG. 3 is a diagram schematically illustrating an exemplary aspect of a developing roller contacting a photoconductive drum when viewed from one side of the image forming apparatus of FIG. 1.

As shown in FIGS. 2 and 3, the developing roller 51 (the developer bearer) contacts the photoconductive drum 1Y to supply toner (i.e., developer) to an electrostatic latent image formed on the photoconductive drum 1Y. The developing roller 51 can be configured by a rotary shaft (e.g., a cored bar) made of conductive metal such as stainless steel, etc., and a roller section made of conductive rubber overlying the rotary shaft. The developer supplying roller 53 (the developer supplying member) is disposed below the pair of first and second toner conveying screws 54 and 55 and is brought in sliding contact with the developing roller 51 to supply toner to the developing roller 51. The developer supplying roller 53 is configured by a cored bar and a conductive polyurethane foam layer (having a resistance value of from about $10^3\Omega$ to about $10^{14}\Omega$) stacked on the cored bar. Here, the developer supplying roller 53 also has a function to remove toner borne on the developing roller 51 not served in a developing process executed in the developing region between the photoconductive drum 1Y and the developing roller 51. The doctor blade 52 (the developer regulatory member) is disposed with is leading end brought in pressure contact with an outer circumferential surface of the developing roller 51 at a certain angle by an amount of pressure from about 10 N/m to about 100 N/m to regulate the amount of developer borne on the developing roller 51. The doctor blade 52 may be configured by a thin plate made of metal such as stainless steel, etc. Here, from a power supply, not shown, a prescribed voltage is applied to each of the developing roller 51, the developer supplying roller 53, and the doctor blade 52 to promote movement of the toner on the developing roller 51 as described later.

These first and second toner conveying screws 54 and 55 (the toner conveying members) installed in the body of the image forming apparatus 100 collectively convey toner housed in the developer unit main section 50 in an axial direction (i.e., a perpendicular to a plane of FIG. 2) thereby forming a toner circulating path. The first toner conveying screw 54 as the first conveyance member is located above the developer supplying roller 53 facing thereto to supply toner onto the developer supplying roller 53 while horizontally conveying the toner in its axial direction from front to back sides (i.e., a longitudinal direction perpendicular to the plane of FIG. 2).

The second toner conveying screw 55 as a second conveyance member is located above and faces the first toner conveying screw 54 via the partition member 56 to horizontally convey the toner in its axial direction from back to front sides (i.e., the longitudinal direction perpendicular to the plane of FIG. 2). Thus, the second toner conveying screw 55 conveys toner circulated from a downstream side of the first toner conveying path B1 established by the first toner conveying screw 54 via a second relay section toward an upstream side of the first toner conveying path B1 through a first relay section. These first and second toner conveying screws 54 and 55 are disposed with these axes almost being horizontal as the developing roller 51 and the photoconductive drum 1Y. Further, around each of these axes of the first and second toner conveying screws 54 and 55, a spiral screw element is wound thereon.

Here, as described above, the first and second toner conveying paths B1 and B2 established by the first and second toner conveying screws 54 and 55 are separated from the other by the partition member 56 (i.e., a wall section). Even not illustrated in the drawing, but the downstream side of the second toner conveying path B2 established by the second toner conveying screw 55 is communicated with the upstream side of the first toner conveying path B1 established by the first toner conveying screw 54 via the first relay section. Specifically, toner reaching the downstream side of the toner conveying path B2 established by the second toner conveying screw 55 freely falls down at the first relay section by its own weight thereby coming to the upstream side of the first toner conveying path B1. Similarly, the downstream side of the first toner conveying path B1 established by the first toner conveying screw 54 is communicated with the upstream side of the second toner conveying path B2 established by the second toner conveying screw 55 via the second relay section. Hence, toner not supplied onto the developer supplying roller 53 in the first toner conveying path B1 remains and makes a pile in the vicinity of the second relay section, and is conveyed (i.e., supplied) to the upstream side of the second toner conveying path B2 through the second relay section. To improve performance of conveyance of toner in the second relay section and efficiently pass the toner from the first to second toner conveying paths B1 and B2 against gravity, either a paddle section or a screw section wound in an opposite direction (to a winding direction of the screw) can be attached to the first toner conveying screw 54 at the downstream side thereof (i.e., a position corresponding to the second relay section).

Further, as shown in FIG. 2, a main section side toner supplying mouth 57 is formed at an upper position in the developer unit main section 50 to communicate with a container side toner supplying mouth 63 formed in the toner container 60. The main section side toner supplying mouth 57 is used to supply toner (developer) to the developer unit main section 50 from the toner container 60. Also, even not shown in the drawing, but to each of the axes of the developing roller 51, the developer supplying roller 53, and the first and second toner conveying screws 54 and 55, a gear is attached while collectively forming a gear train with an idling gear. Hence, to the gear train, driving force is input from a driving motor (i.e., a driving source), not shown, so that the developing roller 51, the developer supplying roller 53, the first and second toner conveying screws 54 and 55 are driven and are rotated in respective directions as shown by arrows in FIG. 2.

Here, the toner container 60 acting as a developer container is configured by an agitator 61, a container side toner conveying screw 62 acting as a container side toner conveying member, and a container side toner supplying mouth 63, or the like. The agitator 61 is prepared by bonding a planner flexible member to a rotary shaft. The agitator 61 conveys toner housed in the container unit C of the toner container 60 toward a toner conveying path established by the container side toner conveying screw 62 when it is rotated counterclockwise in FIG. 2. The container side toner conveying screw 62 (i.e., a container side toner conveying member) conveys toner accommodated in the container toward the container side toner supplying mouth 63 located at a longitudinal end when it is installed in the body of the image forming apparatus 100. That is, the container side toner supplying mouth 63 is formed at one end of the toner conveying path established by the container side toner conveying screw 62 in the longitudinal direction. Subsequently, toner is discharged from the container side toner supplying mouth 63 and is supplied to the upstream side of the second toner conveying path B2 of the developer unit main section 50 through the main section side toner supplying mouth 57 when it falls down by its own weight.

The developer unit 5Y configured in this way operates as follows. First of all, toner is supplied from the toner container 60 to the second toner conveying path B2 through the above-described supplying mouths 57 and 63. The toner supplied in this way is then stirred and mixed with existing toner circulating in the developer unit main section 50 by the second toner conveying screw 55 and is supplied to the first toner conveying path B1. Subsequently, the toner conveyed to the first toner conveying path B1 is further conveyed by the first toner conveying screw 54 and is partially supplied to and borne on the developer supplying roller 53. Subsequently, the toner borne on the developing roller 51 is thinned and uniformed by a doctor blade 52 at a contact position contacting the doctor blade 52. The toner then reaches a contact position contacting the photoconductive drum 1Y (i.e., a developing region). Thus, at this position, the toner adheres to a latent image formed on the photoconductive drum 1Y under influence of an electric field (i.e., a developing electric field) formed in the developing region.

Herein below, a characteristic configuration and operation of an image forming apparatus 100 is described more in detail according to one embodiment of the present invention. As described earlier, the image forming apparatus 100 of this embodiment is a color image forming apparatus in which the multiple process cartridges 6Y, 6M, 6C, and 6K are installed as the image forming units. In the multiple process cartridges 6Y, 6M, 6C, and 6K, the photoconductive drums 1Y, 1M, 1C, and 1K (i.e., the image bearer) and the developing rollers 51 (i.e., the developer bearers) are provided, respectively. In this embodiment, among four process cartridges 6Y, 6M, 6C, and 6K (four image forming units provided therein), three process cartridges 6Y, 6M, and 6C (three image forming units provided therein) other than a process cartridge 6K (one image forming unit provided therein) are controlled by a controller to respectively rotate the developing rollers 51 and the photoconductive drums 1Y, 1M, and 1C in an opposite direction (i.e., a negative rotation direction) to a given direction (i.e., a positive rotation direction) in an ordinary reverse rotation mode when the above-described image forming process is absent and accordingly the image is not formed. The process cartridge 6K (i.e., the image forming unit provided therein) is controlled by the controller to run in a special reverse rotation mode under a different condition from that of the other three process cartridges 6Y, 6M, and 6C (i.e., the image forming units provided therein) in at least one of a rotation time period, start timing, rotational speed, and a frequency of operation. Otherwise, the process cartridge 6K (i.e., the image forming unit provided therein) is controlled not to run in the above-described reverse rotation mode.

Figure 4A:
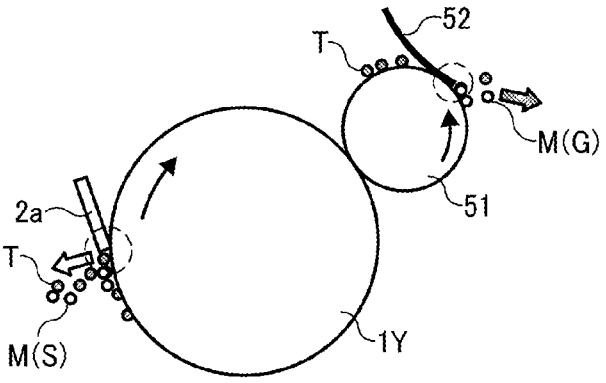
FIG. 4A is a diagram schematically illustrating exemplary operation of the developing roller and the photoconductive drum when an image is formed according to one embodiment of the present invention.
Figure 4B:
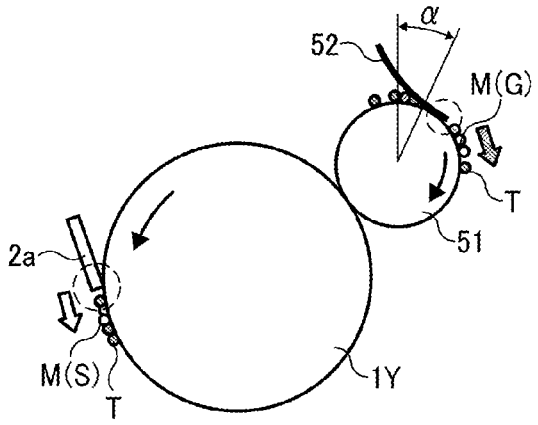
FIG. 4B is a diagram schematically illustrating exemplary operation of the developing roller and the photoconductive drum in a reverse rotation mode according to one embodiment of the present invention.

More specifically, in this embodiment, in the respective four process cartridges 6Y, 6M, 6C, and 6K (i.e., the image forming units provided therein), the reverse rotation modes for rotating the photoconductive drums 1Y, 1M, 1C, and 1K and the developing rollers 51 in reverse are implemented for a given time (i.e., a given distance $\alpha$) when the above-described image forming process has been completed (i.e., after the printing operation). That is, when an image is formed (i.e., an image forming process is executed), the photoconductive drum 1Y (1M, 1C, and 1K) is driven and rotated clockwise while the developing rollers 51 is driven and rotated counterclockwise as shown in FIG. 4A. By contrast, in the reverse rotation mode, the photoconductive drum 1Y (1M, 1C, and 1K) is driven and rotated counterclockwise while the developing rollers 51 is driven and rotated clockwise as shown in FIG. 4B. However, in the reverse rotation mode of the process cartridge 6K for black, at least one of the conditions of the rotation time period, the start timing, the rotational speed, and the frequency or the like set to the photoconductive drum and the developing roller thereof in the reverse rotation mode is differentiated from those of the photoconductive drums and the developing rollers of the other process cartridges 6Y, 6M, and 6C to lower a degree of reverse rotation thereof in the reverse rotation mode.

Figure 6:
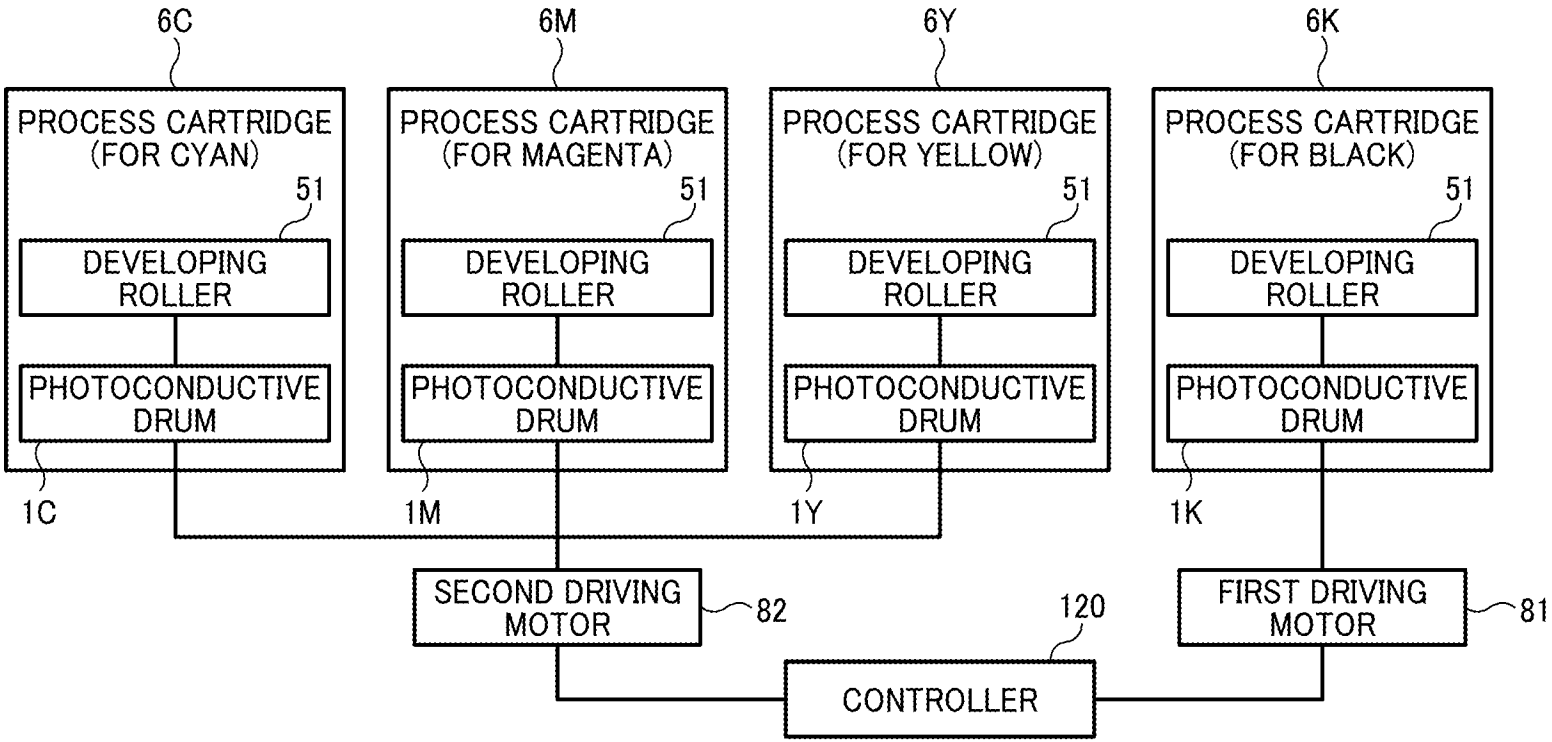
FIG. 6 is a diagram schematically illustrating an exemplary configuration of a drive system that drives the photoconductive drum and the developing roller according to one embodiment of the present invention.

More specifically, as shown in FIG. 6, the photoconductive drum 1K and the developing roller 51 of this embodiment are each positively and reversely driven and rotated by the first driving motor 81 acting as a driving source (i.e., a motor enabled to positively and reversely rotate) via a gear train, not shown, in the black process cartridge 6K. By contrast, in the other respective process cartridges 6Y, 6M, and 6C, the photoconductive drums 1Y, 1M, and 1C and the developing rollers 51 are positively and reversely rotated by a second driving motor 82 (e.g., a motor enabled to positively and reversely rotate) separately acting as a driving source from the first driving motor 81, each via a gear train, not shown. However, in any one of the process cartridges 6Y, 6M, 6C, and 6K, since the first and second driving motors 81 and 82 each commonly drives the photoconductive drum 1Y, 1M, 1C, and 1K and the developing rollers 51, respectively, the photoconductive drums 1Y, 1M, 1C, and 1K and the developing rollers 51 are rotated and stopped rotating at the same time, respectively.

In such a configuration, each time either a series of printing operations is completed or a prescribed number of sheets has been printed, a time period for or a rotational speed of reverse rotation of the first driving motor 81 is adjusted by a controller 120 connected to the first and second driving motors 81 and 82 to be either shorter or slower than a time period for or a rotational speed of reverse rotation of the second driving motor 82. Otherwise, after completion of the series of printing operations or the like, timing of the reverse rotation of the first driving motor 81 is delayed by the controller 120 from timing of the reverse rotation of the second driving motor 82. Yet otherwise, the controller 120 controls the first and second driving motors 81 and 82 such that although the second driving motor 82 generates the reverse rotation every after completion of only one printing job, for example, the first driving motor 81 generates the reverse rotation once every after completion of more than two printing jobs or the like. That is, a frequency of operation of the reverse rotation is differentiated between the first and second driving motors 81 and 82 by the controller 120. Hence, in any one of the above-described situations, a degree of reverse rotation of the black process cartridge 6K is lowered by the controller 120 than each of the other respective process cartridges 6Y, 6M, and 6C in the reverse rotation mode.

Now, advantages of the above-described control are herein below described in detail. That is, as shown in FIG. 4A, when an image is normally formed initially, almost all of untransferred toner T adhering to a surface of the photoconductive drum 1Y is removed by the cleaning blade 2*a* and moves in a direction as shown by a white arrow in the drawing, thereby ultimately returning into the cleaning unit 2Y. In addition, almost all of foreign substance M such as paper dust S, etc., also adhering to the surface of the photoconductive drum 1Y is removed by the cleaning blade 2*a* as well and moves in the direction as shown by the white arrow in the drawing, thereby ultimately entering the cleaning unit 2Y as well. However, when image forming operation (e.g., printing operation) ends and the photoconductive drum 1Y accordingly stops its rotation driving, a limited amount of the untransferred toner T and the foreign substance M such as paper dust S, etc., are left stuck at a gap between the cleaning blade 2*a* and the photoconductive drum 1Y (i.e., a portion enclosed by a broken line in the drawing, and, in particular, an upstream side contact section). When such a state is neglected for a long time, the untransferred toner T and the foreign substance M such as paper dust S, etc., end up firmly stuck in the gap. Further, when an image is normally formed, toner T is provided to a surface of the developing roller 51 from the developer supplying roller 53 while limiting an amount of the toner T with the doctor blade 52. Accordingly, although some of the toner T is borne as is on the developing roller, almost of all of the other toner T moves in a direction as shown by a black arrow in the drawing and ultimately returns into the developer unit 5Y. In addition, when foreign substance M such as an external additive G (i.e., an agent originally added to toner T), etc., separating from the toner T and adhering to the surface of the developing roller 51 has a relatively larger grain size, almost all of the foreign substance M is similarly eliminated by the doctor blade 52 together with the toner T, and moves in the direction as shown by the black arrow, thereby ultimately returning into the developer unit 5Y as well. However, when the image forming operation (e.g., printing operation) ends and the developing roller 51 accordingly stops its rotation driving together with the photoconductive drum 1Y, a limited amount of the T toner and the foreign substance M such as external additive G, etc., are left stuck at a gap between the doctor blade 52 and the developing roller 51 (i.e., a portion enclosed by a broken line in the drawing). When such a state is neglected for a long time, the untransferred toner T and the foreign substance M end up firmly stuck in the gap.

By contrast, according to this embodiment, as shown in FIG. 4B, after completion of printing operation, a reverse rotation mode is implemented such that both the developing roller 51 and the photoconductive drum 1Y are slightly rotated in reverse by a prescribed driving distance. Thus, the untransferred toner T and the foreign substance M stuck between the cleaning blade 2*a* and the photoconductive drum 1Y move (i.e., are removed) in the direction as shown by a white arrow in the drawing. At the same time, the toner T and the foreign substance M stuck between the doctor blade 52 and the developing roller 51 also move (i.e., are removed) in the direction as shown by a black arrow in the drawing as well.

Figure 5:
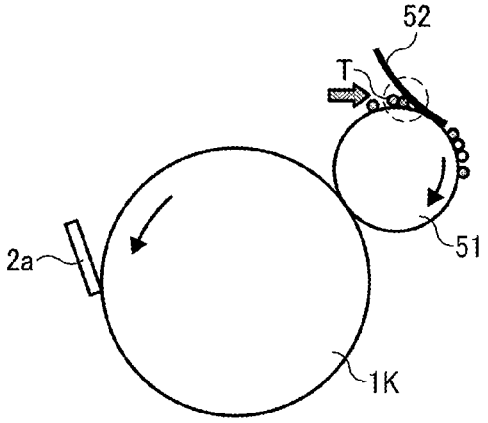
FIG. 5 is a diagram schematically illustrating an exemplary aspect of the developing roller and the photoconductive drum when toner clumps together in a gap between the developing roller and a doctor blade according to one embodiment of the present invention.

However, in each of the four process cartridges 6Y, 6M, 6C, and 6K (i.e., the image forming units provided therein), when the reverse rotation mode is implemented either often or for a relatively long time period (i.e., a long driving distance), the untransferred toner T and the foreign substance M stuck between the cleaning blade 2*a* and the photoconductive drum 1Y sometimes collectively constitute a mass thereof and accordingly damage surfaces of the photoconductive drum 1Y and the cleaning blade 2*a* during the reverse rotation of the photoconductive drum 1Y. As a result, a defective image with banding is formed. In addition thereto, the toner T and the foreign substance M stuck between the doctor blade 52 and the developing roller 51 collectively constitute a mass thereof and accordingly damage surfaces of the developing roller 51 and the doctor blade 52 as well during the reverse rotation of the photoconductive drum 1Y thereby ultimately forming a defective image with banding. Also in such a situation, as shown in FIG. 5, toner T clumping at a downstream side contact section, at which the doctor blade 52 and the developing roller 51 contact each other (i.e., a portion enclosed by a broken line), may firmly adhere to the above-described developing roller 51 and doctor blade 52, thereby easily degrading functionality of the doctor blade 52 (i.e., ability to regulate an amount of toner T) sometimes as a result.

For example, a black process cartridge 6K disposed nearest the fixing unit 20 acting as a high-temperature heat source likely causes the above-described problems because the black process cartridge 6K is closer to the fixing unit 20 and easily gets hot than the other color process cartridges 6Y, 6M, and 6C. Consequently, the untransferred toner T and the foreign substance M stuck between the cleaning blade 2*a* and the photoconductive drum 1Y likely constitute a mass thereof collectively. At the same time, the toner T and the foreign substance M stuck between the doctor blade 52 and the developing roller 51 tend to collectively constitute a mass thereof as well. Accordingly, as described above, at the downstream side contact section at which the doctor blade 52 and the developing roller 51 contact each other, toner T easily adheres thereto firmly as a problem. To solve or lessen such a problem, a degree of reverse rotation of the black process cartridge 6K is set lower than that of the other process cartridges 6Y, 6M, and 6C in the reverse rotation mode. It is also preferable for one of the four process cartridges 6Y, 6M, 6C, and 6K disposed nearest a fan that cools down the image forming apparatus 100 and accordingly easily getting hot due to hot exhaust from the fan (i.e., hot air) to similarly perform the above-described degraded reverse rotation in the reverse rotation mode.

Further, a process cartridge disposed at a position at which paper dust more likely adheres to a surface of the photoconductive drum accommodated therein than the other process cartridges (i.e., image forming units provided therein) also risks causing the above-described problems. For example, in this embodiment, the black process cartridge 6K disposed nearest a sheet conveying path, on which the recording medium P (i.e., a sheet) is conveyed, is prone to raising the above-described problems. Specifically, since paper dust floating from a recording medium P passing through the sheet conveying path more likely adheres to the photoconductive drum 1K of the black process cartridge 6K, when compared to the color process cartridges 6Y, 6M, and 6C, an amount of the paper dust S (i.e., the foreign substance M) stuck between the cleaning blade 2*a* and the photoconductive drum 1Y increases, and accordingly both the untransferred toner T and the foreign substance M collectively constitute a mass thereof easily. In particular, the mass of the untransferred toner T and the foreign substance M can damage surfaces of the photoconductive drum 1Y and the cleaning blade 2*a* during reverse rotation thereof as a problem. Therefore, a degree of reverse rotation of the black process cartridge 6K is again set lower than that of the other process cartridges 6Y, 6M, and 6C to suppress occurrence of such a problem in the reverse rotation mode.

Further, a process cartridge (i.e., an image forming unit provided therein) that uses toner T with more external additives than the other process cartridges (i.e., image forming units provided therein) can be regarded as prone to raising the above-described problem. That is, when an amount of it increases, the external additive G (i.e., the foreign substance M) is increasingly stuck into the gap between the doctor blade 52 and the developing roller 51, so that the toner and the foreign substance M tend to collectively constitute a mass thereof. In particular, the mass of the toner and the foreign substance M likely consequently damages the surfaces of the developing roller 51 and the doctor blade 52 during reverse rotation thereof as a problem. For example, when cyan toner T stored in the process cartridge for cyan 6C employs more external additives than the other yellow toner, magenta toner, and black toner, a degree of reverse rotation of the process cartridge for cyan 6C is set lower than that of the other process cartridges 6Y, 6M, and 6K storing the respective color toner particles to suppress occurrence of such a problem in the reverse rotation mode.

Here, in this embodiment, in a reverse rotation mode, the photoconductive drums 1Y, 1M, 1C, and 1K and the respective developing rollers 51 accommodated therein are rotated in reverse each by a prescribed distance $\alpha$ except for the photoconductive drum 1K and the developing roller 51 thereof. Specifically, the photoconductive drum 1K and the developing roller 51 thereof are rotated by a distance $\alpha'$ less than the prescribed distance $\alpha$.

Figure 7A:
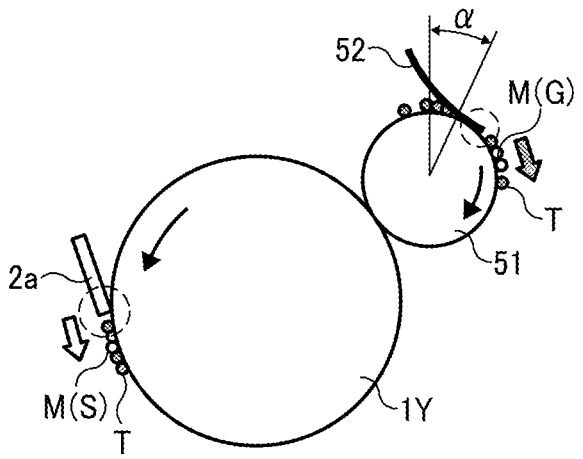
FIGS. 7A and 7B are diagrams collectively illustrating schematically a first exemplary modification of operation of the developing roller and the photoconductive drum in a reverse rotation mode.
Figure 7B:
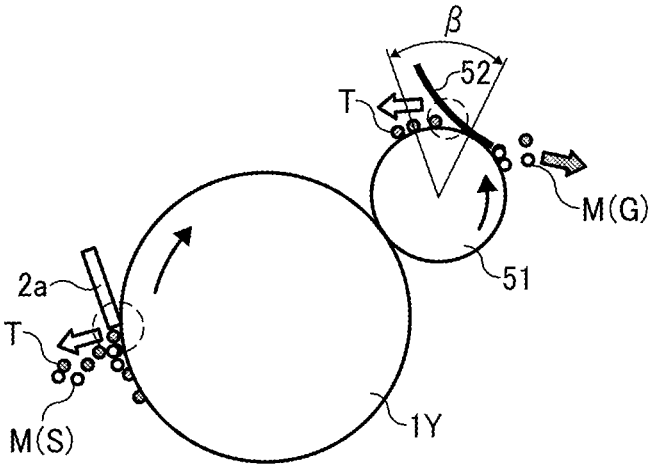

Further, in the reverse rotation mode, the photoconductive drums 1Y, 1M, 1C, and 1K and the respective developing rollers 51 accommodated therein can be rotated in the positive direction each by a prescribed distance $\beta$ except for the photoconductive drum 1K after rotated in reverse by the prescribed distances $\alpha$ and $\alpha'$, respectively, during a non-image formation time period. Here, the photoconductive drum 1K and the developing roller 51 thereof is rotated in the positive direction by a distance $\beta'$ less than the prescribed distance $\beta$. In any way, immediately after completion of printing operation, the photoconductive drum 1Y is driven and rotated in reverse (i.e., counterclockwise) while the developing roller 51 thereof is driven and rotated in the opposite direction thereto (i.e., clockwise) as shown in FIG. 7A. Subsequently, the photoconductive drum 1Y is driven and rotated in the positive direction (i.e., clockwise) while the developing roller 51 thereof is driven and rotated in the opposite direction thereto (i.e., counterclockwise) as shown in FIG. 7B.

With the above-described control, even if untransferred toner T and foreign substance M stuck between the cleaning blade 2*a* and the photoconductive drum 1Y move toward an upstream side as the photoconductive drum 1Y rotates in reverse, the untransferred toner T and foreign substance M reach a position of the cleaning blade 2*a* again and are thereby removed from the photoconductive drum 1Y. At the same time, even if toner T and foreign substance M stuck between the doctor blade 52 and the developing roller 51 move toward an upstream side as the developing roller 51 rotates in reverse, the toner T and foreign substance M reach a position of the doctor blade 52 again and are thereby removed from the developing roller 51. Also, at the same time, toner T agglomerated in a downstream side contact section between the doctor blade 52 and the developing roller 51 by reverse rotation thereof move toward the downstream side (i.e., a direction as shown by a white arrow in the drawing) again. Accordingly, the untransferred toner T and foreign substance M stuck between the cleaning blade 2*a* and the photoconductive drum 1 forcibly move in the direction as shown by a white arrow in the drawing and are effectively removed therefrom to be collected. At the same time, the toner T and foreign substance M stuck between the doctor blade 52 and the developing roller 51 move together in the direction as shown by a black arrow in the drawing and are effectively removed therefrom to be collected. Again, to execute such controlling while reducing the problem as described above with reference to FIGS. 4 and 5, because the black process cartridge 6K is susceptible to impact of heat and invasion of paper dust, a degree of reverse rotation and a rotation time period and a running distance of a positive rotation executed after the reverse rotation thereof need to be set lower than those of other process cartridges 6Y, 6M, and 6C in the reverse rotation mode.

In the above-described control, to ensure effective removal and collection of the toner T and the foreign substance M as well by using the doctor blade 52 and the cleaning blade 2*a*, the driving distance $\alpha$ by which the photoconductive drum 1Y and the developing roller 51 rotate in the opposite direction is preferably set less than the driving distance $\beta$ by which the photoconductive drum 1Y and the developing roller 51 rotate in the positive direction (i.e., $\alpha<\beta$) in the reverse rotation mode. Further, at least in the process cartridges 6Y, 6M, and 6C not prone to raising the problem as described earlier with reference to FIGS. 4 and 5, reverse rotation and successive positive rotation of the photoconductive drum and the developing roller can be repeated several times as a reverse rotation mode.

Figure 8A:
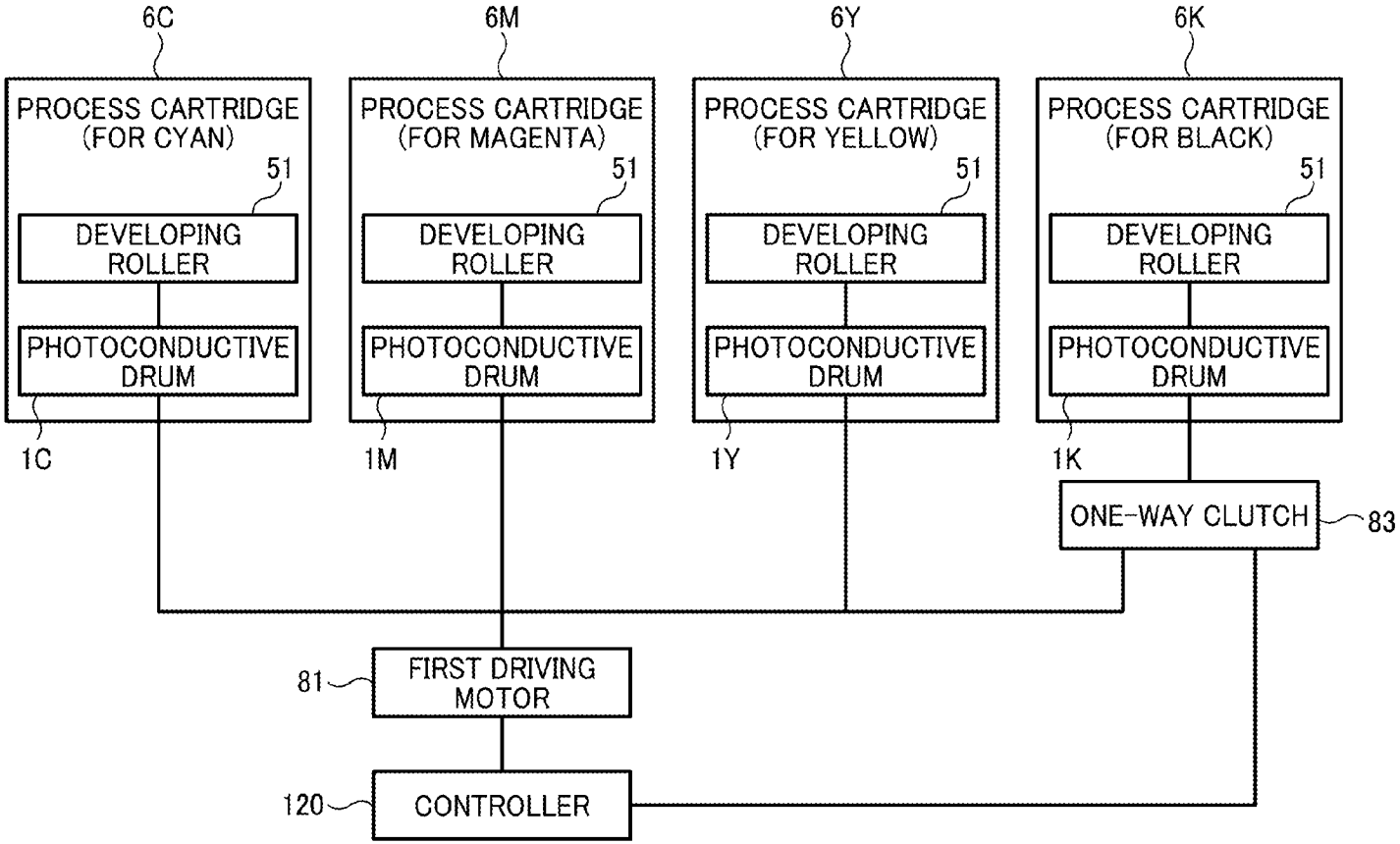
FIGS. 8A and 8B diagrams collectively illustrating schematically a second exemplary modification of a drive system that drives the photoconductive drum and the developing roller.

In this embodiment, to reduce the problem as described above with reference to FIGS. 4 and 5, a degree of reverse rotation of the black process cartridge 6K susceptible to impact of heat and invasion of paper dust is set lower than those of the other process cartridges 6Y, 6M, and 6C by shortening a time period of the reverse rotation, for example, in the reverse rotation mode. By contrast, however, to reduce the problem as described above with reference to FIGS. 4 and 5, a reverse rotation mode can be prohibited in the black process cartridge 6K that is susceptible to impact of heat and invasion of paper dust as well. In such a situation, as shown in FIG. 8A, a single driving motor 81 is provided as a driving source to drive all of the process cartridges 6Y, 6M, 6C, and 6K under control of a controller 120 connected thereto. A one-way clutch (i.e., a clutch only to drive a target in a positive direction when it is connected) 83 connected to the controller 120 is interposed between the driving motor 81 and only the black process cartridge 6K not running in the reverse rotation mode. Hence, the photoconductive drum 1K and the developing roller 51 of the black process cartridge 6K is stopped driving by the controller 120 even when the photoconductive drums 1Y, 1M, and 1C and the developing rollers 51 of the other respective process cartridges 6Y, 6M, and 6C are driven and rotated in reverse.

Figure 8B:
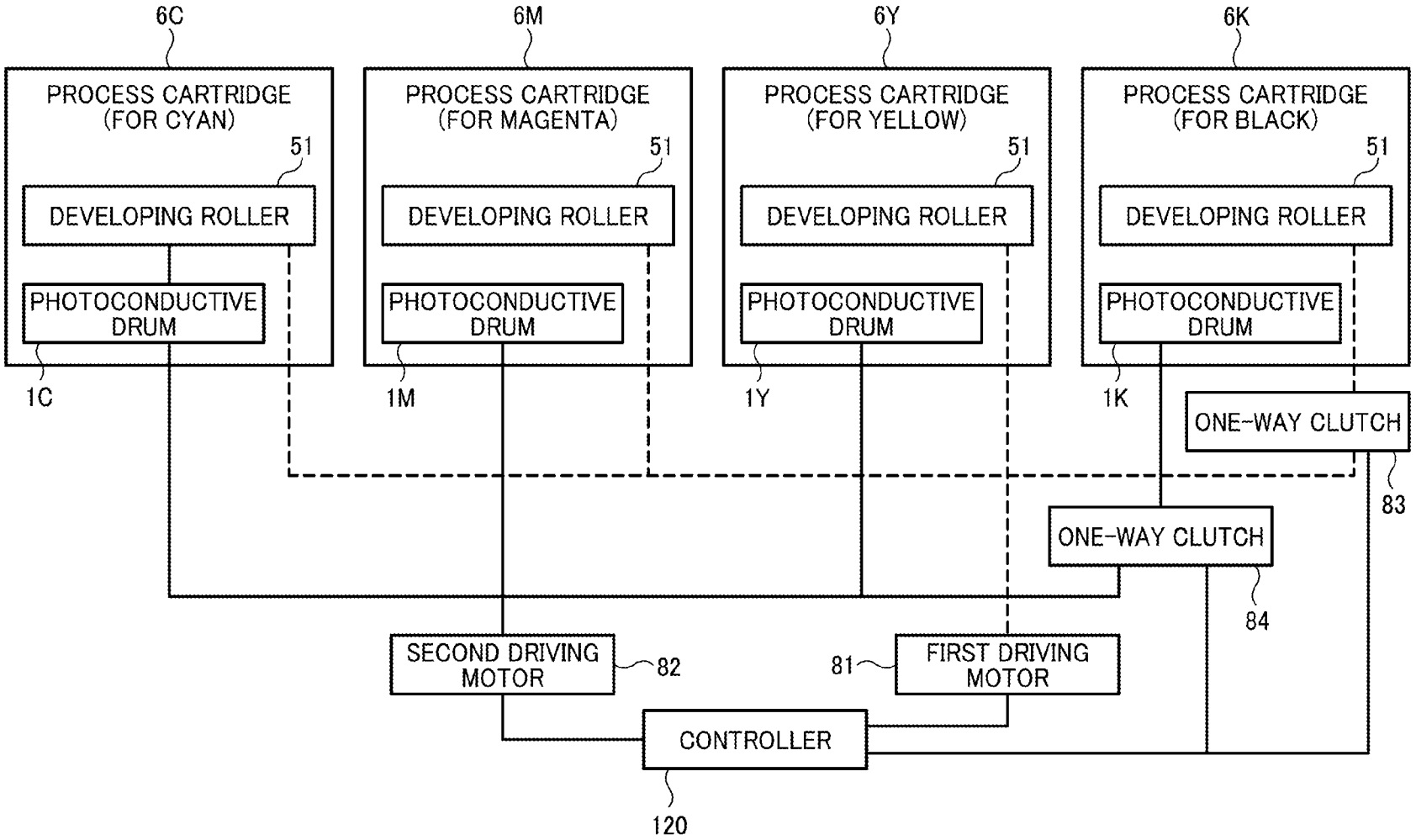

Here, in each of the image forming units of this embodiment, although the photoconductive drum and the developing roller commonly use the same driving motor, the photoconductive drum and the developing roller can separately commonly use multiple driving motors, respectively. In such a situation, when the black process cartridge 6K is set not to run in the reverse rotation mode as in the situation as shown in FIG. 8A, one-way clutches 83 and 84 are again only interposed between the first driving motor 81 and the developing roller 51 and between a second driving motor 82 and the photoconductive drum 1K of the black process cartridge 6K not running the reverse rotation mode to be driven under control of a controller 120 as shown in FIG. 8B, respectively.

As described heretofore, according to various embodiments of the present invention, in an image forming apparatus which accommodates multiple process cartridges 6Y, 6M, 6C, and 6K (i.e., image forming units provided therein), at least the process cartridge 6K is configured to run in a reverse rotation mode in such a manner that at least one of rotation time period, start timing, a rotational speed, and a frequency is differentiated from those employed in the other process cartridges 6Y, 6M, and 6C in the mode. With this, in any of the multiple process cartridges 6Y, 6M, 6C, and 6K, a problem such as a defective image with banding is rarely encounters as a result.

As described heretofore, according to one embodiment of the present invention, the photoconductive drum 1Y (i.e., an image bearer), the developer unit 5Y (i.e., a developer unit main section 50), the electric charging unit 4Y, and the cleaning unit 2Y are integrated as a process cartridge 6Y. However, the present invention is not limited thereto and can be applied, off-course, to a system, in which the photoconductive drums 1Y, the cleaning unit 2Y, electric charging unit 4Y, and the developer unit 5Y are either partially or wholly configured as a unit and separately removable from the body of the image forming apparatus 100 of the image forming apparatus. Even in such a situation, a similar advantage as in the above-described various embodiments can be obtained again. Hereinabove, the process cartridge is defined as a unit detachable from the image forming apparatus body and integrally configured by at least one of an electric charging device that electrically charges an image bearer (i.e., an electric charging device), a developer unit that develops a latent image formed on the image bearer (i.e., a developer unit), and a cleaning device (i.e., a cleaning unit) that cleans the image bearer together with the image bearer.

Further, as described heretofore, according to one embodiment of the present invention, the first and second toner conveying paths B1 and B2 are formed in the developer unit main section 50 of the developer unit 5Y to collectively circulate toner in a longitudinal direction. However, the configuration of the developer unit main section 50 is not limited thereto and a mixing room accommodating a mixing paddle can be disposed in the developer unit main section 50 to stir toner in a vertical direction as well. That is, for example, the mixing paddle is configured by a rotary shaft and a flexible member made of Mylar®, etc., radially attached to the rotary shaft. Further, instead of the container side toner conveying screw 62, an agitator can be provided in the toner container 60 to vertically mix and convey toner, while a container side toner supplying mouth 63 and a main section side toner supplying mouth 57 are formed at multiple locations along an axis direction (a longitudinal direction). Off-course, the present invention can be applied to a system, in which a process cartridge is disposed below an intermediate transfer belt, so that a doctor blade 52 contacts a lower portion of a developer unit 5Y and a developing roller rotates upward to a developing region from the lower portion. Even in such a system, a similar advantage can be again obtained as in the above-described various embodiments of the present invention.

Further, as described heretofore, according to one embodiment of the present invention, the developer unit 5Y of the image forming apparatus 100 is configured is a one-component developing system with the developing roller 51 contacting the photoconductive drum 1Y without a gap. However, the present invention can be applied to an image forming apparatus configured by a developer unit of a non-contact type one component developing system with a developing roller opposed to a photoconductive drum via a gap. Further, as described heretofore, according to one embodiment of the present invention, the developer unit 5Y of the image forming apparatus 100 stores one component developer solely consisting of toner as developer. However, the present invention can be also applied to an image forming apparatus in which a developer unit storing two-component developer including toner and carrier as a developer is installed. Even in such a situation, however, the similar advantage can be obtained as in the above-described various embodiments of the present invention.

Further, as described heretofore, according to one embodiment of the present invention, the photoconductive drum and the developing roller are rotated in reverse in the reverse rotation mode. However, only one of the photoconductive drum and the developing roller can be selectively rotated in reverse in the reverse rotation mode as well. Even in such a situation, however, the similar advantage can be again obtained in one of the photoconductive drum and the developing roller that acts as a reverse rotation objective as in the above-described various embodiments of the present invention. Further, as described heretofore, according to one embodiment of the present invention, the reverse rotation mode is implemented immediately after completion of the printing. However, a reverse rotation mode is available as far as it is a non-image formation time period. For example, the reverse rotation mode can run during a warming up time before printing operation starts.

Further, the number, the position, and the shape or the like of the various components as described heretofore according to various embodiments of the present invention are not limited thereto, and a suitable number, position, and shape or the like can be employed in carrying out the present invention.

Hence, according to one aspect of the present invention, an image forming apparatus can inhibit generation of a defective image with banding or the like in each of multiple image forming units provided therein. That is, the one aspect of the present invention provides a novel image forming apparatus that includes multiple image forming units driven by at least one driving motor under control of a driving controller. Each of the multiple image forming units includes an image bearer to bear a latent image while traveling in a first direction to provide positive rotation, and a developer bearer opposed to the image bearer to develop the latent image borne on the image bearer to obtain a toner image while traveling in a second direction opposite the first direction to provide positive rotation. The driving controller controls the at least one driving motor to render the image forming units other than at least one prescribed image forming unit of the multiple image forming units each to run in an ordinary reverse rotation mode, in which at least one of the image bearer and the developer bearer included in each of the image forming units other than at least one prescribed image forming unit of the multiple image forming units rotates in an opposite direction to a corresponding one of the first direction and the second direction to provide ordinary reverse rotation during a non-image formation time period. The driving controller either differentiates one of a rotation time period, a start timing, a rotational speed, and a frequency of operation of the at least one driving motor from those used in the ordinary reverse rotation mode of the image forming units other than the at least one prescribed image forming unit of the multiple image forming units and runs the at least one prescribed image forming unit in a special reverse rotation mode, in which at least one of the image bearer and the developer bearer included in the at least one prescribed image forming unit rotates in the opposite direction to a corresponding one of the first direction and the second direction based on the differentiated one of a rotation time period, a start timing, a rotational speed, and a frequency of operation to provide special reverse rotation during the non-image formation time period, or stops the at least one driving motor not to run the at least one prescribed image forming unit in the special reverse rotation mode.

According to another aspect of the present invention, an image forming apparatus can more effectively inhibit generation of an defective image with banding or the like in each of multiple image forming units provided therein. That is, the at least one prescribed image forming unit is disposed at a position hotter than positions of the other image forming units.

According to yet another aspect of the present invention, an image forming apparatus can more effectively inhibit generation of an defective image with banding or the like in each of multiple image forming units provided therein. That is, the at least one prescribed image forming unit is disposed at a position more susceptible to paper dust adhering to a surface of the image bearer in the at least one prescribed image forming unit than positions of the other image forming units.

According to yet another aspect of the present invention, an image forming apparatus can more effectively inhibit generation of an defective image with banding or the like in each of multiple image forming units provided therein. That is, the at least one prescribed image forming unit uses toner to which a greater amount of external additives is added than toner used in each of the other image forming units.

According to yet another aspect of the present invention, an image forming apparatus can more effectively inhibit generation of an defective image with banding or the like in each of multiple image forming units provided therein. That is, the at least one of the image bearer and the developer bearer rotates in the corresponding one of the first direction and the second direction again during the non-image formation time period after rotating in the opposite direction to the corresponding one of the first direction and the second direction in the ordinary reverse rotation mode and the special reverse rotation mode.

According to yet another aspect of the present invention, an image forming apparatus can more effectively inhibit generation of an defective image with banding or the like in each of multiple image forming units provided therein. That is, a running distance of reverse rotation of the at least one of the image bearer and the developer bearer in the ordinary reverse rotation mode and the special reverse rotation mode is less than that of rotation of the at least one of the image bearer and the developer bearer executed again thereafter in the corresponding one of the first direction and the second direction.

According to yet another aspect of the present invention, an image forming apparatus can more effectively inhibit generation of an defective image with banding or the like in each of multiple image forming units provided therein. That is, the reverse rotation of the at least one of the image bearer and the developer bearer and the positive rotation thereof executed thereafter in each of the multiple image forming units is repeated multiple times in the ordinary reverse rotation mode and the special reverse rotation mode.

According to yet another aspect of the present invention, an image forming apparatus can more effectively inhibit generation of an defective image with banding or the like in each of multiple image forming units provided therein. That is, the image bearer and the developer bearer are rotated at the same time in the ordinary reverse rotation mode and the special reverse rotation mode during the non-image formation time period.

Numerous additional modifications and variations of the present invention are possible in light of the above teachings. It is therefore to be understood that within the scope of the appended claims, the present invention may be executed otherwise than as specifically described herein. For example, the image forming apparatus is not limited to the above-described various embodiments and may be altered as appropriate. Similarly, the image forming method is not limited to the above-described various embodiments and may be altered as appropriate. In particular, the order of various steps of the image forming method is not limited to the above-described various embodiments and may be altered as appropriate.

What is claimed is:

1. An image forming apparatus including multiple image forming units driven by at least one driving motor under control of a driving controller, each of the multiple image forming units comprising:

an image bearer to bear a latent image while traveling in a first direction to provide positive rotation;

a developer bearer opposed to the image bearer to develop the latent image borne on the image bearer to obtain a toner image while traveling in a second direction opposite the first direction to provide positive rotation;

wherein the driving controller controls the at least one driving motor to render the image forming units other than at least one prescribed image forming unit of the multiple image forming units each to run in an ordinary reverse rotation mode, in which at least one of the image bearer and the developer bearer included in each of the image forming units other than at least one prescribed image forming unit of the multiple image forming units rotates in an opposite direction to a corresponding one of the first direction and the second direction to provide ordinary reverse rotation during a non-image formation time period, wherein the driving controller either differentiates one of a rotation time period, a start timing, a rotational speed, and a frequency of operation of the at least one driving motor from those used in the ordinary reverse rotation mode of the image forming units other than the at least one prescribed image forming unit of the multiple image forming units and runs the at least one prescribed image forming unit in a special reverse rotation mode, in which at least one of the image bearer and the developer bearer included in the at least one prescribed image forming unit rotates in the opposite direction to a corresponding one of the first direction and the second direction based on the differentiated one of a rotation time period, a start timing, a rotational speed, and a frequency of operation to provide special reverse rotation during the non-image formation time period, or stops the at least one driving motor not to run the at least one prescribed image forming unit in the special reverse rotation mode.

2. The image forming apparatus as claimed in claim 1, wherein the at least one prescribed image forming unit is disposed at a position hotter than positions of the other image forming units.

3. The image forming apparatus as claimed in claim 1, wherein the at least one prescribed image forming unit is disposed at a position more susceptible to paper dust adhering to a surface of the image bearer in the at least one prescribed image forming unit than positions of the other image forming units.

4. The image forming apparatus as claimed in claim 1, wherein the at least one prescribed image forming unit uses toner to which a greater amount of external additives is added than toner used in each of the other image forming units.

5. The image forming apparatus as claimed in claim 1, wherein the at least one of the image bearer and the developer bearer rotates in the corresponding one of the first direction and the second direction again during the non-image formation time period after rotating in the opposite direction to the corresponding one of the first direction and the second direction in the ordinary reverse rotation mode and the special reverse rotation mode.

6. The image forming apparatus as claimed in claim 5, wherein a running distance of reverse rotation of the at least one of the image bearer and the developer bearer in the ordinary reverse rotation mode and the special reverse rotation mode is less than that of rotation of the at least one of the image bearer and the developer bearer executed again thereafter in the corresponding one of the first direction and the second direction.

7. The image forming apparatus as claimed in claim 5, wherein the reverse rotation of the at least one of the image bearer and the developer bearer and the positive rotation thereof executed thereafter in each of the multiple image forming units is repeated multiple times in the ordinary reverse rotation mode and the special reverse rotation mode.

8. The image forming apparatus as claimed in claim 1, wherein the image bearer and the developer bearer are rotated at the same time in the ordinary reverse rotation mode and the special reverse rotation mode during the non-image formation time period.

9. A method of forming an image by using multiple image forming units driven by at least one driving motor under control of a driving controller, comprising the steps of:

bearing a latent image while traveling in a first direction to provide positive rotation in each of the multiple image forming units;

bearing developer and developing a latent image borne on the image bearer to obtain a toner image while traveling in a second direction opposite the first direction to provide positive rotation in each of the multiple image forming units;

running each of the image forming units other than at least one prescribed image forming unit of the multiple image forming units in an ordinary reverse rotation mode during a non-image formation time period by rotating at least one of the image bearer and the developer bearer included in each of the image forming units other than the at least one prescribed image forming unit in an opposite direction to a corresponding one of the first direction and the second direction to provide ordinary reverse rotation;

differentiating one of a rotation time period, a start timing, a rotational speed, and a frequency of operation of the at least one driving motor from those used in the ordinary reverse rotation mode of the image forming units other than the at least one prescribed image forming unit of the multiple image forming units, and either running the at least one prescribed image forming unit in a special reverse rotation mode, in which at least one of the latent image bearer and the developer bearer included in the at least one prescribed image forming unit of the multiple image forming units rotates in the opposite direction to a corresponding one of the first direction and the second direction based on the differentiated one of a rotation time period, a start timing, a rotational speed, and a frequency of operation to provide special reverse rotation during the non-image formation time period, or stopping the at least one driving motor not to run the at least one prescribed image forming unit in the special reverse rotation mode.

10. The method as claimed in claim 9, wherein the step of running the at least one prescribed image forming unit in the special reverse rotation mode is executed at a position hotter than positions of the other image forming units.

11. The method as claimed in claim 9, wherein the step of running the at least one prescribed image forming unit in the special reverse rotation mode is executed at a position more susceptible to paper dust adhering to a surface of the image bearer included in the at least one prescribed image forming unit than positions of the other image forming unit.

12. The method as claimed in claim 9, wherein the step of running the at least one prescribed image forming unit in a special reverse rotation mode is executed in at least one prescribed image forming unit using toner to which a greater amount of external additives is added than toner used in each of the other image forming units.

13. The method as claimed in claim 9, further comprising the step of rotating the at least one of the image bearer and the developer bearer in the corresponding one of the first direction and the second direction again during the non-image formation time period after rotating the at least one of those in the opposite direction to the corresponding one of the first direction and the second direction in the ordinary reverse rotation mode and special reverse rotation mode.

14. The method as claimed in claim 13, further comprising the step of decreasing a running distance of the reverse rotation of the at least one of the image bearer and the developer bearer executed in the ordinary reverse rotation mode and the special reverse rotation mode to less than that of the positive rotation executed again thereafter in the corresponding one of the first direction and the second direction.

15. The method as claimed in claim 13, further comprising the step of repeating the reverse rotation and the positive rotation executed again thereafter of the at least one of the image bearer and the developer bearer multiple times in the ordinary reverse rotation mode and the special reverse rotation mode during the non-image formation time period.

16. The method as claimed in claim 9, further comprising the step of rotating both of the image bearer and the developer bearer at the same time in each of the reverse rotation modes of the image bearer and the developer bearer during the non-image formation time period.

17. An image forming apparatus including multiple image forming units driven by at least one driving source means under control of driving control means, each of the multiple image forming units comprising:

latent image bearing means for bearing a latent image while traveling in a first direction to provide positive rotation; and developer bearing means opposed to the image bearing means for bearing developer and developing a latent image bore on the image bearing means to obtain a toner image while traveling in a second direction opposite the first direction to provide positive rotation;

wherein the driving control means controls the at least one driving source means to render the image forming units other than at least one prescribed image forming unit of the multiple image forming units each to run in an ordinary reverse rotation mode, in which at least one of the latent image bearing means and the developer bearing means included in each of the image forming units other than the at least one prescribed image forming unit of the multiple image forming units rotates in an opposite direction to a corresponding one of the first direction and the second direction to provide ordinary reverse rotation during a non-image formation time period, wherein the driving control means either differentiates one of a rotation time period, a start timing, a rotational speed, and a frequency of operation of the at least one driving source means from those used in the ordinary reverse rotation mode of the image forming units other than the at least one prescribed image forming unit and runs the at least one prescribed image forming unit in a special reverse rotation mode, in which at least one of the latent image bearing means and the developer bearing means rotates in the opposite direction to a corresponding one of the first direction and the second direction based on the differentiated one of a rotation time period, a start timing, a rotational speed, and a frequency of operation to provide special reverse rotation during the non-image formation time period, or stops the at least one driving source means not to run the at least one prescribed image forming unit in the special reverse rotation mode.

18. The image forming apparatus as claimed in claim 17, wherein the at least one of the image bearing means and the developer bearing means rotates in the corresponding one of the first direction and the second direction again during the non-image formation time period after rotating in the opposite direction to the corresponding one of the first direction and the second direction in the ordinary reverse rotation mode and special reverse rotation mode executed.

19. The image forming apparatus as claimed in claim 17, wherein a running distance of the reverse rotation of the at least one of the image bearing means and the developer bearing means in the ordinary reverse rotation mode and the special reverse rotation mode is less than that of the positive rotation of the at least one of the image bearing means and the developer bearing means executed again thereafter in the corresponding one of the first direction and the second direction.

20. The image forming apparatus as claimed in claim 17, wherein the reverse rotation of the at least one of the image bearing means and the developer bearing means and the positive rotation thereof executed thereafter in each of the multiple image forming units are repeated multiple times in the ordinary reverse rotation mode and the special reverse rotation mode.

* * * * *